United States Patent [19]

Choi

[11] Patent Number: 4,825,217

[45] Date of Patent: Apr. 25, 1989

[54] CAR PHONE ANTENNA ASSEMBLY

[75] Inventor: Young J. Choi, Seoul, Rep. of Korea

[73] Assignee: Tae Lim Electronics Co., Ltd., Rep. of Korea

[21] Appl. No.: 154,023

[22] Filed: Feb. 9, 1988

[30] Foreign Application Priority Data

Oct. 19, 1987 [KR] Rep. of Korea ..... 1987-11595

[51] Int. Cl.[4] ..... H01Q 1/32

[52] U.S. Cl. ..... 343/715; 343/745; 343/861

[58] Field of Search ..... 343/715, 713, 745, 749, 343/750, 850, 860, 861

[56] References Cited

U.S. PATENT DOCUMENTS 3,474,453 10/1969 Ireland ..... 343/745
4,238,799 12/1980 Parfitt ..... 343/715
4,266,227 5/1981 Blaese ..... 343/715

FOREIGN PATENT DOCUMENTS 137391 4/1985 European Pat. Off. ..... 343/715

*Primary Examiner*—William L. Sikes
*Assistant Examiner*—Michael C. Wimer
*Attorney, Agent, or Firm*—Saidman, Sterne, Kessler & Goldstein

[57] ABSTRACT

A car phone antenna assembly which comprises a whip, a base mounted on a window of a car and a coupling unit having the structure for a capacitive tuning circuit. The coupling unit further comprises a coupling plate which acts as a coupling capacitor together with the base, first and second inductor members, and a variable capacitor member which can fine tune the resonant frequency of the antenna assembly.

4 Claims, 2 Drawing Sheets

CAR PHONE ANTENNA ASSEMBLY

BACKGROUND OF THE INVENTION

1. Field of the Invention

The present invention relates to a car phone antenna assembly, and more particularly to an antenna assembly which may be mounted on a window of a car and which can transmit and receive radio phone signals in the car phone band frequency range.

2. Description of the Prior Art

In U.S. Pat. No. 4,238,799 there is described a half-wave communications antenna assembly which can be mounted on a non-conductive surface, especially on a window of a vehicle. The above-referenced half-wave assembly is designed for use in the citizens band frequency range (26.965–27.405 MHz) as a mobile communication antenna. The half-wave antenna assembly includes a half-wave inductively loaded radiating whip loaded at its base end by a capacitor plate adapted to be affixed to a non-conductive surface on the vehicle. The capacitor plate is coupled to a coupling plate through the non-conductive surface and forms a coupling capacitor together with the capacitor plate. A tuned circuit is connected to the capacitor plate and is tuned to the resonant frequency of the antenna assembly. Thus, as compared with a ground plane antenna, the above referenced half-wave antenna does not need to be attached to a vehicle by clips or clamps, or by drilling a hole through the surface of the body, but can be mounted to the surface of a non-conductive body rather easily and rapidly.

But, in this type of a half-wave antenna assembly, the radiating whip is for use in the C.B. frequency band and, therefore, is to be continuously loaded by a helical, continuous coil extending about 22 inches and being comprised of copper wire in the form of a 1000 turn. Also, in the lower surface of the whip base acting as a capacitor plate, a tuning slug is slidably received within a channel of the base. The relative position of the tuning slug with respect to the base then allows for fine tuning of the resonant frequency of the half-wave antenna assembly by varying the surface area of the base. Accordingly, the structure of the base becomes complicated. A further disadvantage encountered in such a type of half-wave antenna assembly is that since a tuned circuit including a tapped coil and a capacitor is enclosed in a non-conductive, non-shielding tuning box cover which is retained on the coupling capacitor plate, the size of the tuning box cover must be enlarged to an undesirable degree.

On the other hand, an antenna assembly for cellular car phones is known in the art. This car phone antenna assembly can transmit and receive radio phone signals in the car phone band frequency range (821–896 MHz), and is mounted on a window glass of a car. The above referenced car phone antenna assembly comprises a stainless steel whip coated with black Teflon S, a whip base which allows angle adjustment of the whip, which is affixed to and mounted on a window of a car, and a coupling unit which is coupled to the whip base through the window and acts as an impedance matching circuit between the whip and a transmission cable. Further, a coupling capacitor disposed on the inside of the window just opposite to the whip base, a linear coil and a flat condenser member are also included in the coupling unit. The linear coil and the flat condenser member determines the resonant frequency of the antenna assembly and the facing distance between the flat condenser member and the coupling capacitor plate can be varied by a manual tuning screw installed in the coupling box for further fine tuning of the resonant frequency of the antenna assembly.

Nevertheless, this kind of car phone antenna assembly suffers from disadvantages that the flat condenser member may vibrate mechanically while a car is driven so that the resonant frequency determined by the linear coil and the flat condenser member may be changed slightly, which in turn reduces the gain of the antenna assembly and causes antenna noise to occur. A further disadvantage is that the size of the coupling box is enlarged, since the flat condenser member needs a large installation space.

SUMMARY OF THE INVENTION

It is an object of the present invention to provide a car phone antenna assembly which overcomes the above-described drawbacks and has greater gain and sensitivity than other antennas.

It is another object of the present invention to provide a car phone antenna assembly which has a compact and strong structure and is easily and rapidly mountable.

According to the present invention, there is provided a car phone antenna assembly comprising a whip for use in the car phone band frequency range, a base capable of angle adjustment of the whip, the lower surface of the base being affixed to and mounted on a window of a car and acting as a capacitor plate, and a coupling unit being coupled to the base through the window and acting as not only a radiator but an impedance matching circuit between the whip and a coaxial connector.

The coupling unit has the structure for a C (capacitive) tuning circuit and preferably comprises a coupling plate being placed on the inside of the window just opposite to the base and forming a coupling capacitor together with the base and the window, first inductor member connected to the coupling plate by two links and being made of copper tube, second inductor member connected between the first inductor member and a grounding copper plate, and a variable capacitor member being electrically in contact with the grounding copper plate and including a dielectric tube which is attached to the inner surface of the first inductor member and an adjustment screw which fastens through the dielectric tube. Thus, the facing area between the first inductor member and the adjustment screw is varied by adjusting the adjustment screw and this produces fine tuning of the resonant frquency of the antenna assembly.

BRIEF DESCRIPTIONS OF THE DRAWINGS

A preferred embodiment of the invention will now be described in more detail, by way of example only, with reference to the accompanying drawings, in which:

FIG. 1 is an exploded perspective view of one preferred embodiment of the antenna assembly according to the present invention, FIG. 2 is a front sectional view of the antenna assembly shown in FIG. 1, FIG. 3 is an exploded perspective view showing the coupling box used in a conventional car phone antenna assembly, FIG. 4 is a schematic circuit diagram of the antenna assembly shown in FIG. 1, and FIG. 5 is a perspective view showing the antenna assembly of the present invention installed on a window of a car.

DETAILED DESCRIPTION OF THE PREFERRED EMBODIMENT

Figure 1:
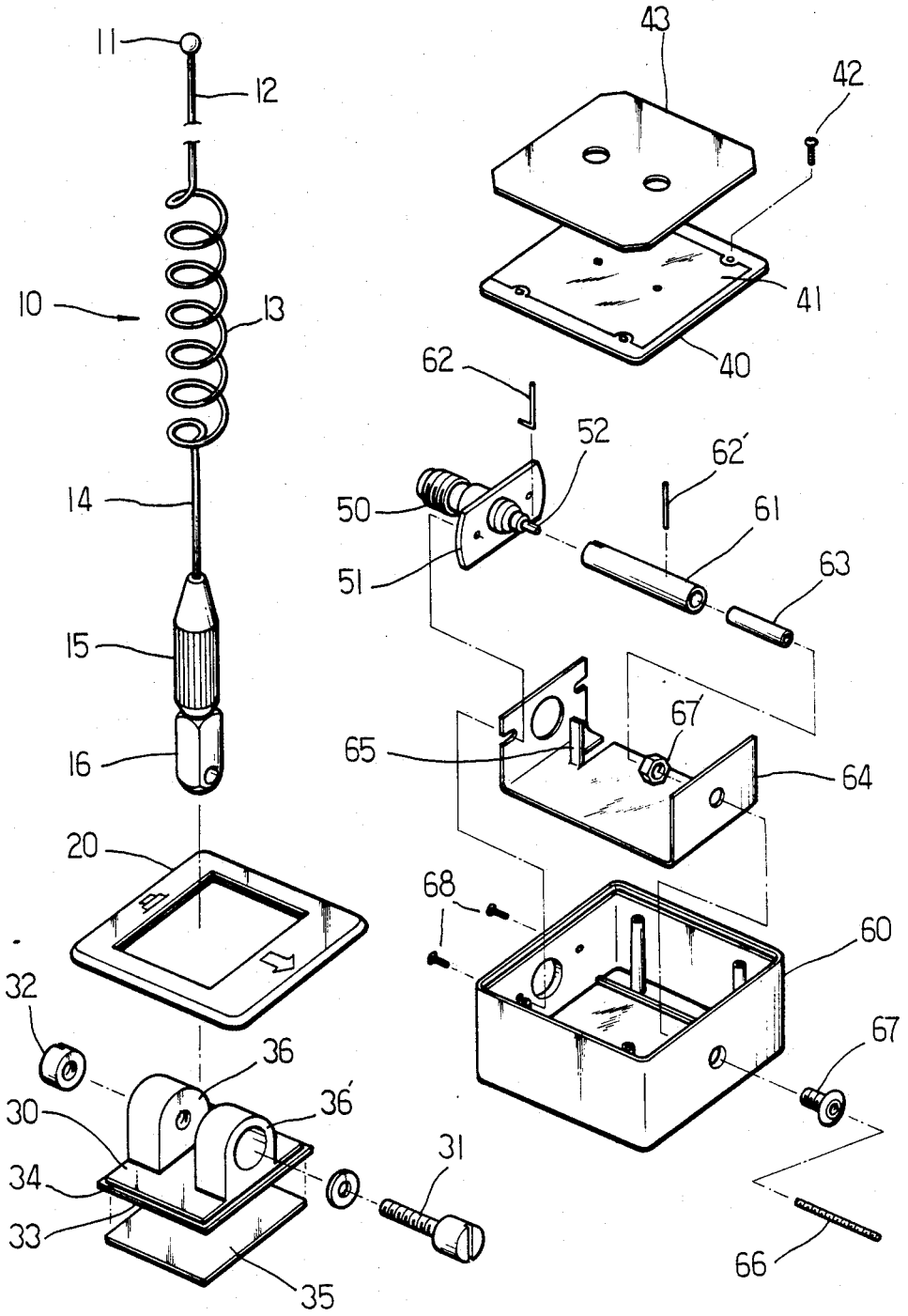
Figure 2:
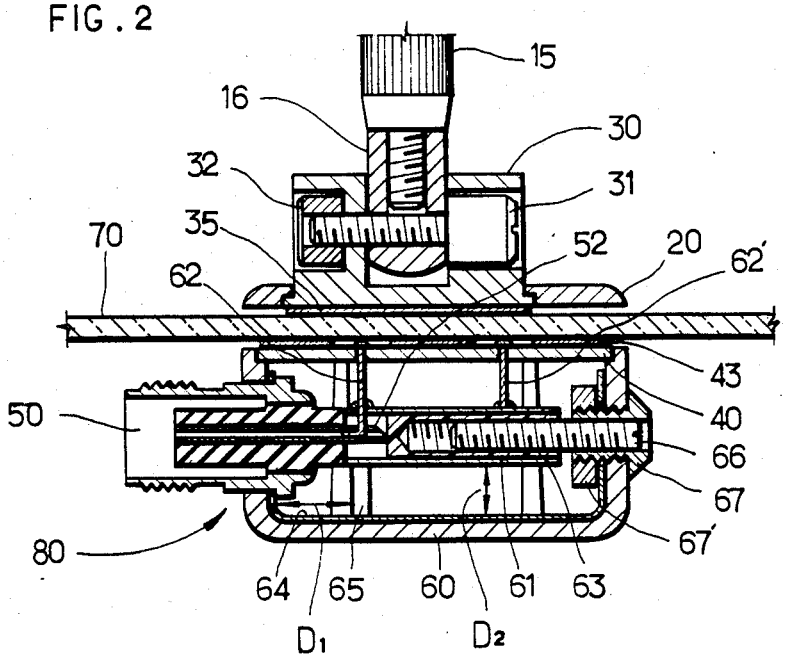

Referring to the drawings in detail, and particularly FIG. 1 and 2, there is shown a preferred embodiment of a car phone antenna assembly incorporating the present invention.

The antenna assembly includes a whip 10, a base 30 and a coupling unit 80. The whip 10 is designed for use in the car phone band frequency range (821–896 MHz). The coupling unit 80 acts as not only a radiating circuit but an impedance matching circuit between the whip 10 and a coaxial connector 50, and thus enables maximum high-frequency energy to be radiated or absorbed.

The earth capacitance of the antenna assembly is determined by the structure of the whip 10. The whip 10 is loaded by a loading coil 13 in the form of a 7.5 turn, helical coil extending approximately 9 cm. The upper remainder 12 of the whip 10, the end of which is connected to a top loading ball 11, extends to $\frac{5}{8}$ wave length (i.e., approximately 17 cm) and the lower remainder 14 of the whip 10, which is terminated in a whip adapter 15, extends to $\frac{1}{4}$ wave length (i.e., approximately 7 cm). Accordingly, the distributed current phases of the remainders 12 and 14 are synthesized by the loading coil 13 and this enables the gain of the antenna assembly to be improved.

The whip adapter 15 is screwed into an adapter mount 16 which is fixed between two lugs 36 and 36' of the base 30 by a set screw 31 and a nut 32, and this structure permits rotation of the adapter mount 16 to facilitate angular adjustment of the whip 10.

In the disclosed embodiment, the overall length of the whip and the base 30 is about 35 cm. Also, the radiation resistance of the whip 10 is about 150 ohms.

A base holder 20 is fitted into a groove 34 of the base 30 and the lower surface 33 of the base 30, which measures 3 cm by 2.5 cm, is affixed to and mounted on a window 70 of a car by a front pad 35 and acts as a capacitor plate serving as one of the two plates comprising a coupling capacitor.

Figure 5:
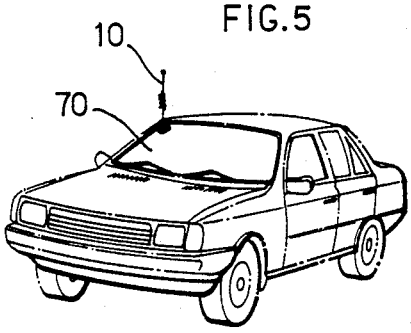

The best mounting location of the whip 10 is, as shown in FIG. 5, the top edge or center of the front or rear window 70 of a car, subject to the positioning of the base 30 and the base holder 20 being at least $\frac{1}{4}$ inch apart from a window frame.

A coupling plate 40 is disposed and mounted by a back pad 43 on the inside surface of the window 70 just opposite to the base 30 and is fixed to a coupling box 60 by screws 42. As previously stated, the lower surface 33 of the base 30 and a sheet copper 41 coated on the coupling plate 40 together with the window 70 act as the coupling capacitor. In the disclosed embodiment, the sheet copper 41 on the coupling plate 40 measures $3.45 \times 2.5$ cm and the capacitance of the coupling capacitor is 1.89 PF.

Figure 4:
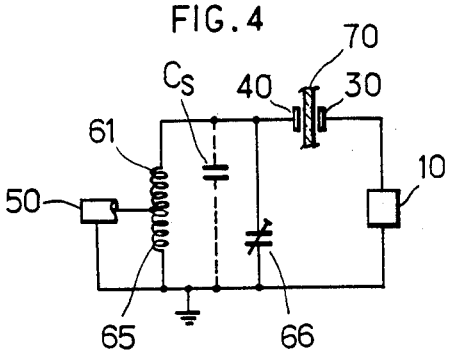

First and second inductor members 61 and 65 and a variable capacitor member, which form a C tuning circuit as shown in FIG. 4, are enclosed in the coupling box 60.

The first inductor member 61 taking the form of a copper tube is connected to the sheet copper 41 on the coupling plate 40 by two links 62 and 62' for the transmission of high-frequency energy. Also, one end of the first inductor member 61 is electrically connected to the center conductor 52 of the coaxial connector 50. In the disclosed embodiment, the outer diamter of the first inductor member 61 is 5 mm.

The second inductor member 65 is connected between the first inductor member 61 and a grounding copper plate 64 to which the outer conductor 51 of the coaxial connector 50 is also connected and fixed. In the preferred embodiment of the present invention, the second inductor member 65 is made by cutting and bending a part of the grounding copper plate 64.

The inductances of the first and the second inductor members 61 and 65 are 6.6 NH and 13.5 NH respectively in the disclosed embodiment.

A variable capacitor member comprises a dielectric tube 63 which is attached to the inner surface of the first inductor member 61 and has a threaded hole for screwing on and an adjustment screw 66 which is electrically connected and fixed to the grounding copper plate 64 by a bolt 67 and a nut 67' and fastens through the dielectric tube 63. In the preferred embodiment, the dielectric tube is made of synthetic resin. Thus, the facing area between the first inductor member 61 and the screw 66 is varied by adjusting the screw 66 and the distributed capacitance between the first inductor member 61 and the screw 66 is varied, resulting in that the resonant frequency in use is fine tuned. In the preferred embodiment, the capacitance of the variable capacitor member is 0.9 PF puls or minus 0.3 PF. Also, the stray capacitance Cs between the variable capacitor member and the grounding copper plate 64 is 0.2 PF.

Further, the nominal resonant frequency of the antenna assembly according to the present invention is determined by the combination of the resonant capacitance formed by the first and second inductor members 61 and 65 of the variable capacitor member, the distributed capacitance formed by the base 30 and the sheet copper 41 of the coupling plate 40, and the earth capacitance of the whip 10.

Figure 3:
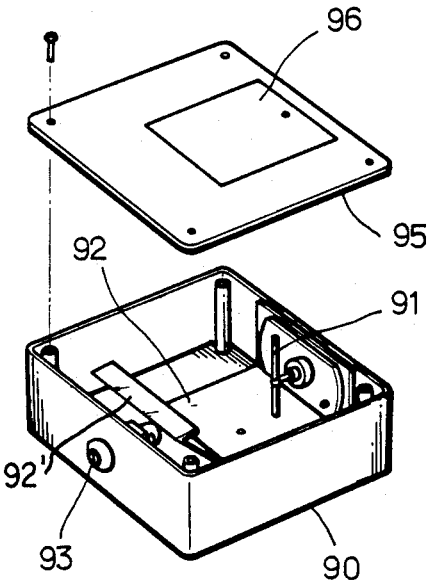
FIG. 3 PRIOR ART

Referring now to FIG. 3, there is shown the coupling unit of a conventional car phone antenna assembly. In the coupling box 90, a linear coil 91 is connected between a grounding copper plate 92 and a sheet copper 96 coated on a coupling plate 95. The bent portion 92' of the grounding copper plate 92 and the sheet copper 96 on the coupling plate 95 are comprised of a flat condenser member and the facing distance between the bent portion 92 and the sheet copper 96 is varied by adjusting a tuning screw 93.

Thus, the distributed capacitance between the bent portion 92' and the sheet copper 96 is varied by varying the facing distance between them and this enables the resonant frequency of the antenna assembly to be fine tuned. But, a disadvantage encountered in such a type of coupling box is that since the flat condenser member needs a large installation space a large coupling box 90 is required. Further, the resonant frequency determined by the flat condenser member may be varied because the bent porton 92' of the grounding copper plate 92 may vibrate mechanically while a car is driven, and this appearance reduces the gain of the antenna assembly and causes antenna noise to occur.

According to the preferred embodiment of the present invention, the variable capacitor member does not generate such mechanical vibration. Also the size of the coupling box 60 is reduced since the variable capacitor member is small in structure. In the disclosed embodiment, the coupling box 60 measures only $4 \times 4 \times 2$ cm.

Further, the coupling box 60 can be cast in plastic and its appearance is attractive.

The input impedance of the coupling unit according to the present invention is determined by the theory of Transmission-Line-Loaded small antennas and matches that of the coaxial connector 50, typically about 50 ohms. That is, the input impedance in the frequency range in use is determined by the facing distances $D_1$ and $D_2$ between the second inductor member 65 and the side of the grounding copper plate 64 and between the first inductor member 61 and the bottom of the grounding copper plate 64 respectively. Substantially, the input impedance is in inverse proportion to the facing distance $D_1$ and is in proportion to the facing distance $D_2$. In the disclosed embodiment, the facing distances $D_1$ and $D_2$ are about 1 cm and about 0.6 cm respectively. Thus, the standing wave ratio (SWR) at the resonant frequency is quite favorably improved by adjusting the position of the link 62, facing area of the variable capacitor member and the facing distance $D_2$ properly.

From the foregoing, it will be apparent that the present invention provides a novel car phone antenna assembly specially designed and constructed to provide greater gain and sensitivity, having a compact and strong structure, and being able to be cast attractively in plastic.

Whereas the present invention has been described in particular relation to the drawings attached hereto, it should be understood that other and further modifications, apart from those shown or suggested herein, may be made within the spirit and scope of this invention.

What is claimed is:

1. A car phone antenna assembly comprising:

a whip for use in the car phone band frequency range;

a base, connected to an end of said whip, affixed to and mounted on a window of a car, and acting as a capacitor plate which serves as one of the two plates comprising a coupling capacitor; and a coupling unit comprising:

a coupling plate being mounted on the inside of said window just opposite to said base, being fixed to a coupling box, and said coupling plate and said base, together with said window acting as said coupling capacitor;

a first inductor comprising an at least partially hollow copper tube located a distance from said coupling plate, joined to said coupling plate by two links, said copper tube connected across said distance to said coupling plate by said two links for the transmission of high-frequency energy, wherein a first end of said first inductor is connected to a coaxial connector;

a second inductor being connected between said first inductor and a grounding copper plate affixed to said coupling box; and a variable capacitor comprising said first inductor and an adjustment screw connected to said grounding copper plate with a dielectric tube physically interposed between said first inductor and said adjustment screw, said variable capacitor for fine tuning the resonant frequency of the antenna assembly based on the position of said adjustment screw with respect to said first inductor.

2. A car phone antenna assembly as claimed in claim 1, wherein:

said dielectric tube is attached to an inner surface of said first inductor and has a threaded hole; and said adjustment screw is electrically connected and fixed to said grounding copper plate and is threaded into said dielectric tube in said threaded hole;

whereby the facing area between said first inductor and said adjustment screw is varied by adjusting said adjustment screw, whereby distributed capacitance between said first inductor and said adjustment screw is varied.

3. A car phone antenna assembly as claimed in claim 2, wherein said adjustment screw is electrically connected and affixed to said grounding copper plate by a bolt and a nut, whereby said bolt has a threaded hole through which said adjustment screw is screwed.

4. A car phone antenna assembly as claimed in claim 1, wherein said second inductor comprises a part of said grounding copper plate.

* * * * *